US008288068B2

(12) United States Patent
Gal et al.

(10) Patent No.: US 8,288,068 B2
(45) Date of Patent: Oct. 16, 2012

(54) TONER COMPOSITIONS FOR DECREASING BACKGROUND DEVELOPMENT IN LIQUID ELECTROSTATIC PRINTING AND METHODS FOR MAKING AND USING SAME

(75) Inventors: Victor Gal, Rehovot (IL); Galia Golodetz, Rehovot (IL); Jose Kuperwasser, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 623 days.

(21) Appl. No.: 12/281,520

(22) PCT Filed: Mar. 9, 2007

(86) PCT No.: PCT/US2007/006075

§ 371 (c)(1),
(2), (4) Date: Nov. 24, 2008

(87) PCT Pub. No.: WO2007/106396

PCT Pub. Date: Sep. 20, 2007

(65) Prior Publication Data

US 2009/0305160 A1 Dec. 10, 2009

Related U.S. Application Data

(60) Provisional application No. 60/781,019, filed on Mar. 10, 2006.

(51) Int. Cl.
*G03G 13/10* (2006.01)
*G03G 9/00* (2006.01)

(52) U.S. Cl. ..... 430/117.1; 430/114; 430/116; 430/137.19

(58) Field of Classification Search ..... 430/114, 430/116, 117, 137.19, 117.1
See application file for complete search history.

(56) References Cited

U.S. PATENT DOCUMENTS

| | | | | |
|---|---|---|---|---|
| 4,289,678 | A * | 9/1981 | Calder et al. | 524/273 |
| 5,607,808 | A * | 3/1997 | Nishizawa et al. | 430/137.19 |
| 2002/0006571 | A1* | 1/2002 | Suda et al. | 430/114 |
| 2004/0023143 | A1* | 2/2004 | Ben-Avraham et al. | 430/114 |
| 2006/0194138 | A1* | 8/2006 | Regev et al. | 430/114 |

FOREIGN PATENT DOCUMENTS

| | | |
|---|---|---|
| JP | 3-171149 | 7/1991 |
| JP | 03171149 | 7/1991 |

* cited by examiner

*Primary Examiner* — Thoral Chea

(57) ABSTRACT

A toner for use in liquid electrostatic printing, comprising: a carrier liquid; and, a plurality of toner particles, the toner particles being comprised of a pigment; and a mixture of resins, a major portion of the mixture comprising at least a first resin and a minor portion comprising at least one second resin, the second resin having an affinity for the pigment, that is greater than the affinity of the first resin for the pigment, such that the amount of free pigment in the carrier liquid separate from the toner particles is reduced over the amount that would be present in the absence of the at least one second resin of the minor portion.

19 Claims, 2 Drawing Sheets

TONER COMPOSITIONS FOR DECREASING BACKGROUND DEVELOPMENT IN LIQUID ELECTROSTATIC PRINTING AND METHODS FOR MAKING AND USING SAME

RELATED APPLICATIONS

The present application claims priority under 35 U.S.C. §119(e) to U.S. Provisional Application No. 60/781,019, filed Mar. 10, 2006, the disclosure of which is incorporated herein.

FIELD OF INVENTION

The present invention relates generally to Liquid Electrostatic Printing ("LEP") and more specifically to improving image quality by reducing background development.

BACKGROUND OF THE INVENTION

The formation and development of latent images on the surface of photoconductive materials using liquid toner, the LEP process, is well known. The basic process involves placing a uniform electrostatic charge on a photoconductive insulating layer, exposing the layer to a light and shadow image to dissipate the charge on the areas of the layer exposed to the light and developing the resultant latent image by depositing on the image, having a background portion at one potential and a "print" portion at another potential, a finely divided electroscopic material known in the art as "toner". The toner will normally be attracted to those areas of the layer which retain a charge, thereby forming a toner image corresponding to the latent electroscopic image. This image may then be transferred to a support surface such as paper. The transferred image may then be permanently affixed to the support surface by the application of heat, solvent, overcoating treatment or other affixing processes.

The LEP process typically utilizes a liquid developer comprising a carrier liquid having a high electric resistance and low dielectric constant and toner particles dispersed in the carrier liquid. The toner particles usually contain various components such as a binder (resin), a charge adjuvant and pigment. One problem with the LEP process as it is currently performed is that a small percentage of the pigment particles do not bind to the toner particles during the mixing process. As a result, these loose particles may not deposit properly during the printing process. These loose pigment particles cause image degradation by depositing on background areas of the photoreceptor and the final substrate. This phenomenon is known as background development. In addition to image degradation, background development has been found to shorten the life span of the photoconductor and the printing blanket.

In powder xerography background development can be reduced by using large carrier beads to scavenge stray ink particles. However, these large carrier beads typically have a size of 100-300 microns and cannot be applied in regular LEP liquid developer (LEP particle size is typically in the range of 1-10 microns). Moreover this technique requires a two component toner system whereas LEP toner is only generally comprised of one component.

SUMMARY OF THE INVENTION

The loose pigment particle problem described above is particularly noticeable when printing is performed on transparent substrates. One reason is because a large amount of pigment is typically used in the toner in order to achieve the opacity required of a printed image on a transparent substrate.

This is especially true when white ink is used, for example to provide a background for colors. This high loading is reflected in relatively high amounts of free pigment (not encapsulated in the resin). The free pigment is not charged correctly and, as a result, is deposited on the background area of the prints. Since the printing is performed on transparent substrates, the "polluted" background has an adverse effect on the print quality.

Another difficulty in the LEP process, related to the loose pigment problem, is the undercharging of toner particles in the liquid developer. Much like loose pigment, undercharged toner particles do not carry the necessary charging for optimum LEP operation. This results in undercharged particles depositing on uncharged areas of the photoconductive insulating layer, which also causes background development.

Therefore, an aspect of some embodiments of the invention relates to liquid toner formulations which reduce the background in LEP printing by making pigment more compatible with a binding resin. In an exemplary embodiment of the invention, a minor amount of an additional material having a high affinity for the pigment and preferably also to the resin is added to the toner, generally as part of the toner particles. In various exemplary embodiments of the invention, the affinity is physical, chemical or both. This high affinity material is, for example, a cross-linked copolymer. In an exemplary embodiment of the invention, background is reduced by capture of the pigment particles by the additional material and the incorporation of the pigment particles (which would otherwise be loose) into the toner particles. Optionally, the additional material is porous to facilitate the capture of loose pigment and incorporation of the additional material into the resin particles. Optionally, the additional material swells in the carrier liquid, although it may not solvate the liquid.

In some exemplary embodiments of the invention, cross-linked copolymers are used which include acrylic acid moieties. Optionally, the cross-linked copolymer is comprised of polyacrylic ester. Optionally, the cross-linked copolymer is comprised of polybutyl methacrylate. Optionally, the cross-linked copolymer is comprised of polymethyl methacrylate. In some exemplary embodiments of the invention, the cross-linked copolymer includes a polar moiety, such as a copolymer comprised of alkyl acrylate and ethyleneglycol dimethacrylate.

During production of the toner, the copolymer is swollen by the carrier liquid. Background is reduced by the interaction between free pigment and resin particles with the swollen cross-linked copolymer matrix, which preferably has an affinity with the main toner resin. Optionally, the toner particles are between 1-10 microns in diameter.

In some exemplary embodiments of the invention, pigment is used which has been pre-treated for enhanced compatibility with the binder resin and/or the additional material. Optionally, the pigment used is hydrophobic.

In an exemplary embodiment of the invention, a toner is provided with a silica additive which reduces the background in the printing process. It is believed that silica assists with the reduction of background during printing by improving the swelling properties of the cross-linked copolymer matrix and/or interacting directly with the free pigment and resin particles.

In an exemplary embodiment of the invention, a toner is provided which contains at least a cross-linked copolymer and a silica additive. Optionally, the silica additive comprises 0.1%-4% of the total weight of the cross-linked copolymer additive. By using certain cross-linked copolymers in conjunction with a silica additive, background can be further reduced over using only one or the other component. Optionally, the cross-linked copolymer comprises 1-15% by total weight of the pigment. In an exemplary embodiment of the invention, a toner is provided in which the cross-linked copolymer and silica effect on background is greater than the sum of their total. In other words, there is appears to be a synergistic effect, in contrast to just an additive effect, between the cross-linked copolymer and the silica additive.

An aspect of the invention relates to providing a liquid toner which is comprised of at least two resins, each having different swelling ratios such that the second resin has a swelling ratio which gives it more affinity to loose pigment particles than the swelling ratio of the first resin. In some embodiments of the invention, the second resin has a physical and/or chemical affinity for the first resin and the pigment particles. Optionally, the second resin is a cross-linked copolymer or polymer.

An aspect of some embodiments of the invention relates to a method for preparing an improved toner composition containing a resin that scavenges pigment, and optionally silica.

In an embodiment of the invention, the toner is produced in a conventional manner, in which the majority resin solvates the carrier liquid at an elevated temperature and then is ground at a lower temperature to form toner particles. In an embodiment of the invention, the additional material and the pigment are added at the start or during the grinding process. Alternatively, the additional material and the pigment are separately wet ground (in the presence of carrier liquid) and then the ground additional material with pigment is added to the majority resin and ground together with it. In some exemplary embodiments of the invention, the additional material is added prior to the grinding process. Optionally, the additional material is added to the carrier liquid and the majority resin prior to salvation. Optionally, the additional material is added during solvation. Optionally, the additional material is premixed with the Isopar, at least one resin, at least one pigment, and/or the charge adjuvant before its addition to the toner.

An aspect of the invention is to provide a method for reducing background in liquid electrostatic printing by performing the printing process with an improved toner composition as described herein.

There is thus provided in accordance with an exemplary embodiment of the invention, a toner for use in liquid electrostatic printing, comprising: a carrier liquid; and, a plurality of toner particles, the toner particles being comprised of a pigment; and a mixture of resins, a major portion of said mixture comprising at least a first resin and a minor portion comprising at least one second resin, the second resin having an affinity for said pigment, that is greater than the affinity of the first resin for the pigment, such that the amount of free pigment in the carrier liquid separate from the toner particles is reduced over the amount that would be present in the absence of the at least one second resin of the minor portion. In an exemplary embodiment of the invention, the minor portion is a cross-linked copolymer or polymer. In an exemplary embodiment of the invention, the minor portion comprises a matrix. In an exemplary embodiment of the invention, the minor portion is a porous material. In an exemplary embodiment of the invention, the minor portion swells in the carrier liquid and wherein said affinity for the pigment is present at least when the minor portion is swelled. In an exemplary embodiment of the invention, the minor portion has at least an affinity for said major portion. Optionally, minor portion is comprised of an acrylic acid moiety. Optionally, the minor portion is comprised of a polar moiety. Optionally, the minor portion is a copolymer of acryl acrylate and ethylene glycol dimetharylate. Optionally, the minor portion is comprised of polybutyl methacrylate. Optionally, the minor portion is comprised of polymethyl methacrylate. Optionally, the minor portion is comprised of polyacrylic ester. In some exemplary embodiments of the invention, the toner particles also contain silica in an amount effective to further reduce the amount of free pigment in the carrier liquid. Optionally, the minor portion contains silica. Optionally, the silica comprises 0.1-4% by weight of the minor portion. Optionally, the amount of minor portion is 1-15% by weight of the amount of the pigment added.

There is thus provided in accordance with an exemplary embodiment of the invention, a toner for use in liquid electrostatic printing, comprising: a carrier liquid; and, a plurality of toner particles, the toner particles being comprised of a pigment; and a mixture of at least two resins, a major portion of said mixture comprising at least one first resin with a first swelling ratio and a minor portion comprising at least one second resin having second swelling ratio, wherein said second resin has an affinity for said pigment, at least when swelled according to the second swelling ratio in the carrier liquid, that is greater than the affinity of the first resin for the pigment, such that the amount of free pigment in the carrier liquid separate from the toner particles is reduced over the amount that would be present in the absence of the at least one second resin of the minor portion. In an exemplary embodiment of the invention, the minor portion is a cross-linked copolymer or polymer. In an exemplary embodiment of the invention, the minor portion comprises a matrix. In an exemplary embodiment of the invention, the minor portion is a porous material. In an exemplary embodiment of the invention, the minor portion swells in the carrier liquid and wherein said affinity for the pigment is present at least when the minor portion is swelled. In an exemplary embodiment of the invention, the minor portion has at least an affinity for said major portion. Optionally, minor portion is comprised of an acrylic acid moiety. Optionally, the minor portion is comprised of a polar moiety. Optionally, the minor portion is a copolymer of acryl acrylate and ethylene glycol dimetharylate. Optionally, the minor portion is comprised of polybutyl methacrylate. Optionally, the minor portion is comprised of polymethyl methacrylate. Optionally, the minor portion is comprised of polyacrylic ester. In some exemplary embodiments of the invention, the toner particles also contain silica in an amount effective to further reduce the amount of free pigment in the carrier liquid. Optionally, the minor portion contains silica. Optionally, the silica comprises 0.1-4% by weight of the minor portion. Optionally, the amount of minor portion is 1-15% by weight of the amount of the pigment added.

There is thus provided in accordance with an exemplary embodiment of the invention, a toner for use in liquid electrostatic printing, comprising: a carrier liquid; and, a plurality of toner particles, the toner particles being comprised of a pigment; and a mixture of at least two resins, a major portion of said mixture comprising at least one first resin and a minor portion comprising at least one second resin having a matrix structure suitable for capturing the pigment, such that the amount of free pigment in the carrier liquid separate from the toner particles is reduced over the amount that would be present in the absence of the at least one second resin of the minor portion. In an exemplary embodiment of the invention, the minor portion is a cross-linked copolymer or polymer. In an exemplary embodiment of the invention, the minor portion comprises a matrix. In an exemplary embodiment of the invention, the minor portion is a porous material. In an exemplary embodiment of the invention, the minor portion swells in the carrier liquid and wherein said affinity for the pigment is present at least when the minor portion is swelled. In an exemplary embodiment of the invention, the minor portion has at least an affinity for said major portion. Optionally, minor portion is comprised of an acrylic acid moiety. Optionally, the minor portion is comprised of a polar moiety. Optionally, the minor portion is a copolymer of acryl acrylate and ethylene glycol dimetharylate. Optionally, the minor portion is comprised of polybutyl methacrylate. Optionally, the minor portion is comprised of polymethyl methacrylate. Optionally, the minor portion is comprised of polyacrylic ester. In some exemplary embodiments of the invention, the toner particles also contain silica in an amount effective to further reduce the amount of free pigment in the carrier liquid. Optionally, the minor portion contains silica. Optionally, the silica comprises 0.14% by weight of the minor portion. Optionally, the amount of minor portion is 1-15% by weight of the amount of the pigment added.

There is thus provided in accordance with an exemplary embodiment of the invention, a method of preparing liquid toner, comprising: mixing at least a carrier liquid, a resin and a polymer to produce a slurry of the carrier liquid and plasticized polymer particles; adding a cross-linked copolymer and a pigment to said slurry; and, grinding the slurry, the cross-linked copolymer and pigment to form pigmented toner particles, wherein the cross-linked copolymer reduces the amount of one or both of free resin and pigment particles than would have been present if the cross-linked copolymer had not been added. In some exemplary embodiments of the invention, the method further comprises adding silica. In an embodiment of the invention, the cross-linked copolymer is comprised of a material with an affinity for the pigment and the resin. In an embodiment of the invention, the cross-linked copolymer is porous material. In an embodiment of the invention, the pigment is white. In an embodiment of the invention, the cross-linked copolymer has a different swelling ratio than the resin, such that the swelling of the cross-linked copolymer increases the affinity of the cross-linked copolymer to one or both of the resin and pigment particles. In an embodiment of the invention, the cross-linked copolymer has a matrix structure suitable for capturing the pigment. In an embodiment of the invention, the cross-linked copolymer is swollen to produce a matrix structure suitable for capturing the pigment.

There is thus provided in accordance with an exemplary embodiment of the invention, a method of preparing liquid toner, comprising: mixing at least a carrier liquid, a resin and a polymer to produce a slurry of the carrier liquid and plasticized polymer particles; adding a pigment to said slurry; and, grinding the slurry and the pigment, and at the start of or during grinding adding a cross-linked copolymer wherein the cross-linked copolymer reduces the amount of one or both of free resin and pigment particles than would have been present if the cross-linked copolymer had not been added. In some exemplary embodiments of the invention, the method further comprises adding silica. In an embodiment of the invention, the cross-linked copolymer is comprised of a material with an affinity for the pigment and the resin. In an embodiment of the invention, the cross-linked copolymer is porous material. In an embodiment of the invention, the pigment is white. In an embodiment of the invention, the cross-linked copolymer has a different swelling ratio than the resin, such that the swelling of the cross-linked copolymer increases the affinity of the cross-linked copolymer to one or both of the resin and pigment particles. In an embodiment of the invention, the cross-linked copolymer has a matrix structure suitable for capturing the pigment. In an embodiment of the invention, the cross-linked copolymer is swollen to produce a matrix structure suitable for capturing the pigment.

There is thus provided in accordance with an exemplary embodiment of the invention, a method of printing an image on a substrate comprising: generating a charge distribution responsive to the image on a surface; contacting the surface with a toner according to any of the embodiments described herein or produced according to any of methods described herein to form a developed image; and transferring the developed image from the surface to the substrate.

BRIEF DESCRIPTION OF THE FIGURES

Non-limiting embodiments of the invention will be described with reference to the following description of exemplary embodiments, in conjunction with the figures. The figures are generally not shown to scale and any measurements are only meant to be exemplary and not necessarily limiting. In the figures, identical structures, elements or parts which appear in more than one figure are preferably labeled with a same or similar number in all the figures in which they appear, in which.

DETAILED DESCRIPTION OF EXEMPLARY EMBODIMENTS

General

Figure 1:
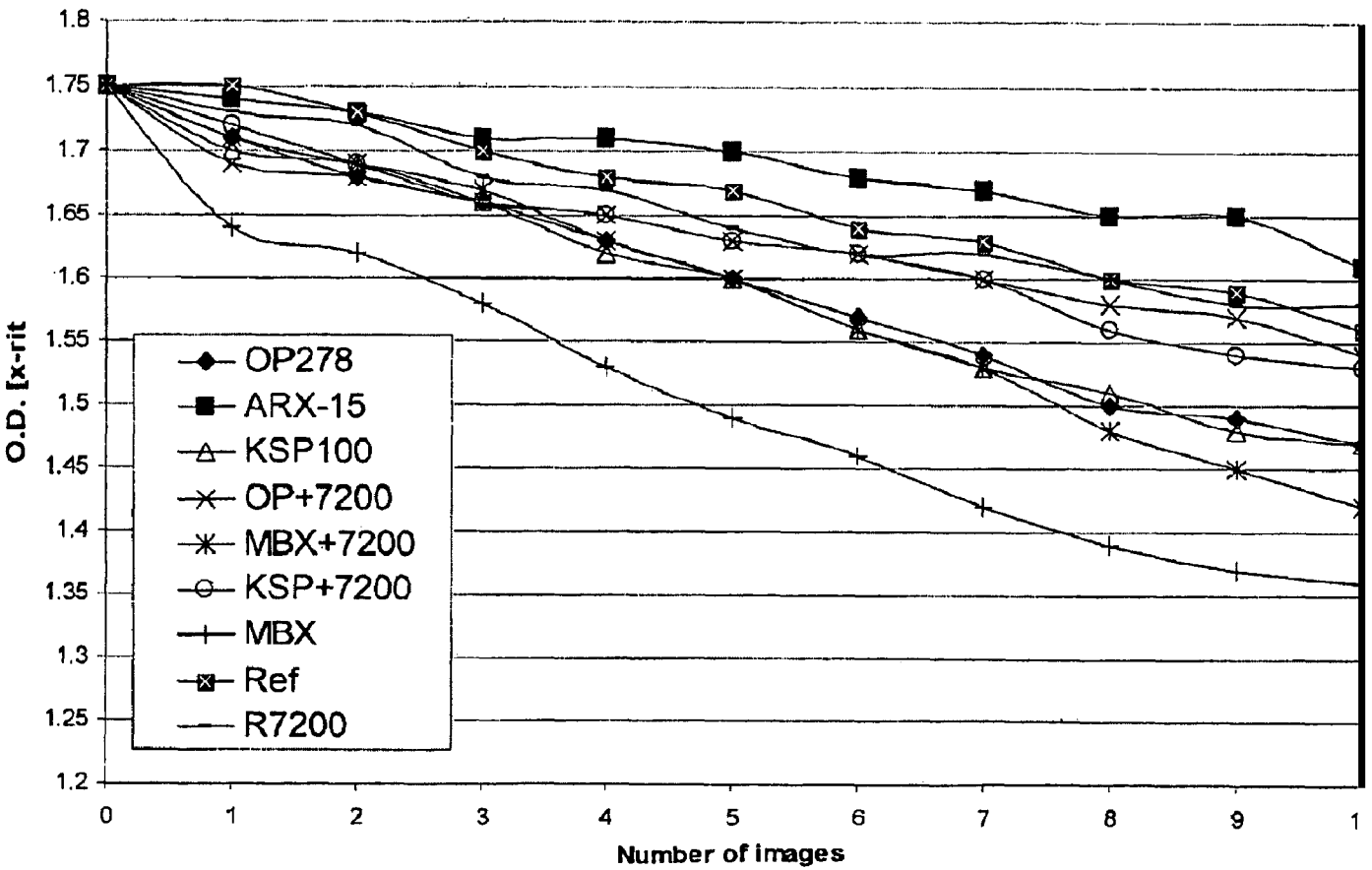
FIG. 1 depicts a graph showing experimental results regarding the improvement in background development performance using varying combinations of cross-linked copolymers and silica.

It has been demonstrated that background in conventional LEP printing is primarily caused by excess pigment and resin particles being deposited in undesired areas. As described above, these particles are not deposited in the desired location on the printed image primarily as a result of insufficient charging of these particles. The present inventors have determined that these free particles can be captured by the toner particles by supplying conventional liquid toner with an additional material that has a higher affinity for the pigment than the majority resin used and which also has an affinity for the majority resin. In an embodiment of the invention the additional material is a resin such as a cross-linked copolymer. Additionally, silica can be added to the toner in order to provide enhanced reduction of background during the printing process.

Preparation of Toner Material

In accordance with an embodiment of the invention, the inventive toner may be prepared from its ingredients using any of various methods known in the art for preparing clear or pigmented toners, with the addition of a cross-linked copolymer as an ingredient. Additionally or alternatively to the cross-linked copolymer, silica is optionally added to the toner mixture.

In an embodiment of the invention, a black toner may be prepared by preparing a mixture of a carrier liquid (comprising about 60%-85% by total weight), for example a hydrocarbon fluid known as Isopar-L®, an ethylene methacrylic acid copolymer resin such as Nucrel® 699 (10%-35%), and an ethylene acrylic acid copolymer such as A-C® 5120 (5%-30%). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry is then added to a one gallon-attritor (e.g. a Union Process® 01 attritor) together with at least one pigment such as Monarch® 800 carbon black pigment manufactured by Cabot® (15%-25% by total weight of the solids) and Alkali Blues D6200 manufactured by BASF® (1%-10% by total weight of the solids), a cross-linked copolymer such as poly-acrylic ester (marketed as ARX-15 and manufactured by Sekisui Plastics Co., Ltd.) (1%-15% by total weight of the added pigment) and a charge adjuvant like Aluminum Tristearate (1%-5% by total weight of the solids). In some exemplary embodiments of the invention, pigment is used which has been pre-treated for enhanced compatibility with the majority (binder) resin and/or the additional material. Optionally, the pigment used is hydrophobic.

It should be noted that any cross-linked copolymer or other polymer which operates to absorb the free resin and pigment particles is optionally used in place of ARX-15. In an exemplary embodiment of the invention, a cross-linked copolymer or other polymer is selected for use based upon its affinity for the binder resin (e.g. Nucrel® 699) and the pigment, the resin's and pigment's attraction for the cross-linked copolymer, or both. Materials which are optionally used as binder resins include one or more of: ethylene acrylic acid copolymers, terpolymers of ethylene, acrylic ester and maleic anhydride, acid-modified ethylene acrylate polymers, acid/acrylate-modified ethylene vinyl acetate, and copolymers of ethylene with any chemically functional monomer.

Optionally, at least the additional material, e.g., the cross-linked copolymer, is added during a grinding step described herein. The materials are ground for example, at 52° C., 250 rpm for about 1.5 hours. The temperature is reduced to 40° C. and the mixture is ground for another 10.5 hours. Unless otherwise noted, percentages specified herein referring to concentrations are percentages by weight. Optionally, pre-ground silica and/or pre-ground cross-linked copolymer is added to the toner mixture after grinding.

In an embodiment of the invention, the additional material and the pigment are added at the start or during the grinding process. Alternatively, the additional material and the pigment are separately wet ground (in the presence of carrier liquid) and then the ground additional material with pigment is added to the majority resin and ground together with it. In some embodiments of the invention, the additional material is added prior to the grinding process. Optionally, the additional material is added to the carrier liquid and the majority binder resin prior to solvation. Optionally, the additional material is added during solvation. Alternatively, the additional material is premixed with the carrier liquid, at least one resin, at least one pigment, and optionally the charge adjuvant before its addition to the toner.

In some exemplary embodiments of the invention, an additive material is chosen which increases the physical affinity (possibly in addition to the chemical affinity) between the loose particles and the binder resin. Optionally, cross-linked porous materials such as MBP porous, cross-linked copolymers, manufactured by Sekisui Plastics Co., Ltd. in Japan are added to the toner mixture for this purpose.

In an exemplary embodiment of the invention, a white toner is prepared by preparing a mixture of a carrier liquid such as Isopar-L® (comprising about 75% by total weight), a resin such as Nucrel® 699 (comprising about 20% by total weight), and a polymer such as A-C® 5120 (comprising about 5% by total weight). The ingredients are mixed in a double planetary mixer, for example a Ross mixer, for about 1.5 hours at a temperature between about 120° C. to about 160° C. to produce a slurry of the carrier and polymer particles plasticized by solvation of the liquid carrier. The mixing is then continued for another 1.5 hours while the mixture cools down to room temperature. The slurry is then added (48.62% by total weight of the solids) to a one gallon attritor (e.g. a Union Process® 01 attritor) together with Titanium dioxide pigment Ti-Pure R104 manufactured by Du-Pont® (48.78%) and citric acid (<0.1%) manufactured by Sigma and Heliogen Blue D7080 manufactured by BASF® (0.003%), a cross-linked copolymer such as poly-acrylic ester (marketed as ARX-15 and manufactured by Sekisui Plastics Co., Ltd.) (2.5%). The materials are ground at 55° C., 250 rpm for about 15 hours.

An alternative method for preparing the inventive toner is to first premix the ARX-15 with the pigments (in the above examples the carbon black and Alkali Blue® or the titanium dioxide and Heliogen Blue) in slurry of 1%-50% with Isopar-L® as the liquid carrier. After an hour of premixing, the slurry can be added to the attritor along with the slurry of the plasticized polymer and the charge adjuvant, optionally Aluminum Tristearate. The grinding procedure would be the same as described above.

Similar procedures can be used to produce another white toner. In an exemplary embodiment of the invention, instead of the carbon black and the Titanium dioxide-pigment, a white pigment like Ti-Pure R104 or Tronox® 470 (approx. 50% by total weight), manufactured by Kerr-McGee®, and Heliogen® Blue D7086 (0.01% by weight of the Tronox® pigment), manufactured by BASF®, can be loaded into the attritor. The attritor operates at 55° C. for approximately 3 hours and is cooled down to 35° C. at which temperature grinding is continued for about another 12 hours.

Upon completion of the grinding step, the mixture comprises toner particles having an average diameter of under 6 micrometers dispersed in the carrier liquid, in an exemplary embodiment of the invention. Additional carrier liquid may be added in order to provide a liquid toner with a desired concentration of solid toner particles. For example, less than 20% by total weight. Optionally, the concentration of solid toner particles is provided at between 1% and 2%. The manufacturing of the inventive liquid toner is optionally completed by adding: a charge director (about 3% by total weight of toner particles+about 0.5% by total weight of the carrier liquid); Marcol® 82 (about 1% by total weight of toner particles); and, Teflon® powder (about 3% by total weight of the toner particles). An example of an appropriate charge director for this purpose is described in U.S. Pat. No. 5,346,796 to Almog, the disclosure of which is incorporated herein by reference.

Operation of the Toner

As mentioned above, it has been determined through experimentation that the addition of a cross-linked copolymer to otherwise conventional liquid toner helps to reduce the background in liquid electrostatic printing. Furthermore, using silica as an additive to liquid toner may also reduce background. It has also been shown through experimental testing that adding a cross-linked copolymer and silica together to otherwise conventional liquid toner produces an enhanced reduction of background in LEP printing relative to adding the cross-linked copolymer or the silica alone.

In order to test whether background is reduced, a black page was printed multiple times with a white toner image. The optical density in the black areas which should not have been printed with the white was measured. This is a very sensitive measure of white toner on the background.

Table I, below, presents the results of the experimentation carried out in this area. The row across the top indicates the additive used and the column along the left hand side indicates the number of times the white image was printed on the black background. The data in the table is normalized to a same starting optical density.

TABLE I

Optical density measurements

| | Ref | ARX-15 | MBX | MBX + R7200 | OP278 | OP + R7200 | KSP100 | KSP + R7200 | R7200 |
|---|---|---|---|---|---|---|---|---|---|
| 0 | 1.75 | 1.75 | 1.75 | 1.75 | 1.75 | 1.75 | 1.75 | 1.75 | 1.75 |
| 1 | 1.75 | 1.74 | 1.64 | 1.71 | 1.71 | 1.69 | 1.7 | 1.72 | 1.73 |
| 2 | 1.73 | 1.73 | 1.62 | 1.69 | 1.68 | 1.68 | 1.69 | 1.69 | 1.72 |
| 3 | 1.7 | 1.71 | 1.58 | 1.67 | 1.66 | 1.66 | 1.66 | 1.66 | 1.68 |
| 4 | 1.68 | 1.71 | 1.53 | 1.63 | 1.63 | 1.65 | 1.62 | 1.65 | 1.67 |
| 5 | 1.67 | 1.7 | 1.49 | 1.6 | 1.6 | 1.63 | 1.6 | 1.63 | 1.64 |
| 6 | 1.64 | 1.68 | 1.46 | 1.56 | 1.57 | 1.62 | 1.56 | 1.62 | 1.62 |
| 7 | 1.63 | 1.67 | 1.42 | 1.53 | 1.54 | 1.6 | 1.53 | 1.6 | 1.62 |
| 8 | 1.6 | 1.65 | 1.39 | 1.48 | 1.5 | 1.58 | 1.51 | 1.56 | 1.6 |
| 9 | 1.59 | 1.65 | 1.37 | 1.45 | 1.49 | 1.57 | 1.48 | 1.54 | 1.58 |
| 10 | 1.56 | 1.61 | 1.36 | 1.42 | 1.47 | 1.54 | 1.47 | 1.53 | 1.58 |

The experiment which provided the results listed in Table I measured the background produced using different formulations of toner using cross-linked copolymer and/or silica additives including:

1. ARX-15—96%-99.9% of a copolymer of cross-linked alkyl acrylate and ethyleneglycol dimethacrylate+ 0.1%4% of silica;
2. MBX-15—a copolymer of cross-linked methyl methacrylate;
3. OP-278—Acematt® beads of a copolymer of butylacrylate and styrene embedded in polymethyl methacrylate matrix;
4. KSP-100—cross-link of vinyl dimethicone and methicone silsequloxane (a cross-linked silicone); and,
5. Aerosil® R7200 (hydrophobic silica).

From the above additive materials, various toner formulations were prepared for testing, including:

1. A reference toner—contained none of the above additives;
2. ARX-15—comprising 10% of the total toner particle weight;
3. MBX-15—10%;
4. MBX-15—10%+R7200 (R7200 being 4% of MBX-15);
5. OP-278—10%;
6. OP-278—10%+R7200 (4% of OP-278);
7. KSP-100—10%;
8. KSP-100—10%+R7200 (4% of KSP-100); and,
9. R7200—contained only a silica additive, 0.4% of the total pigment particle weight.

A graphic representation of the data in the chart is depicted in FIG. 1. It can be seen from Table I and FIG. 1 that the optical density of the substrate using toner with ARX-15 as an additive did not drop as quickly as the reference toner. In other words, the addition of ARX-15 to conventional liquid toner reduces background in comparison to printing with traditional toner (compare the optical density measurements of ARX-15 with the Ref column). The data also indicates that using silica as an additive, without the addition of a cross-linked copolymer also reduced background in comparison to traditional toner. In fact, using silica as an additive in every case provided enhanced reduction of background during LEP printing. However, this reduction was not as good as when the silica was combined with the cross-linked copolymer ARX-15.

While the actual mechanism that provides the reduction of background is not positively known, it is believed that the mechanism of decreasing the background involves interaction of the free pigment and/or resin particles with the matrix of the cross-linked copolymer. In some exemplary embodiments of the invention, cross-linked polymers are used which include acrylic acid moieties. It is believed that because binder resins such as Nucrel® 699 are based on copolymers of ethylene and acrylic acid, the presence of such a moiety in the cross-linked copolymer improves the compatibility of the additive material and the resin. Naturally, a variety of additive materials can be chosen based on their compatibility to whichever resin is used in the toner formulation. For example, alcohol, glycol and amine based additive materials could also be suitable depending on the resin being used.

Furthermore, it has been experimentally shown that the matrix of the additional material, the cross-linked copolymer, swells upon submersion in a carrier liquid. Therefore, it is believed that the loose pigment and resin particles are removed from their free-floating state by absorption into the swollen polymer matrices. In a sense, the free particles become "trapped" in the matrices.

It is believed that even though swelling as a percentage of the KSP100 material is high (see Table II, below), it is not effective for reducing the background in LEP printing using the toners conventionally used in the art. This may be due to the fact that KSP100 is based on a silicone polymer, which does not exhibit a high affinity for the binder resin based on copolymers of ethylene and acrylic acid. It is also possible that the matrix of the KSP100 does not exhibit a favorably sized structure for trapping the loose particles after it has swollen. Referring to OP278, it is believed that its poor performance is due to the fact that it contains polystyrene, which is also not compatible with the binder resin.

Figure 2:
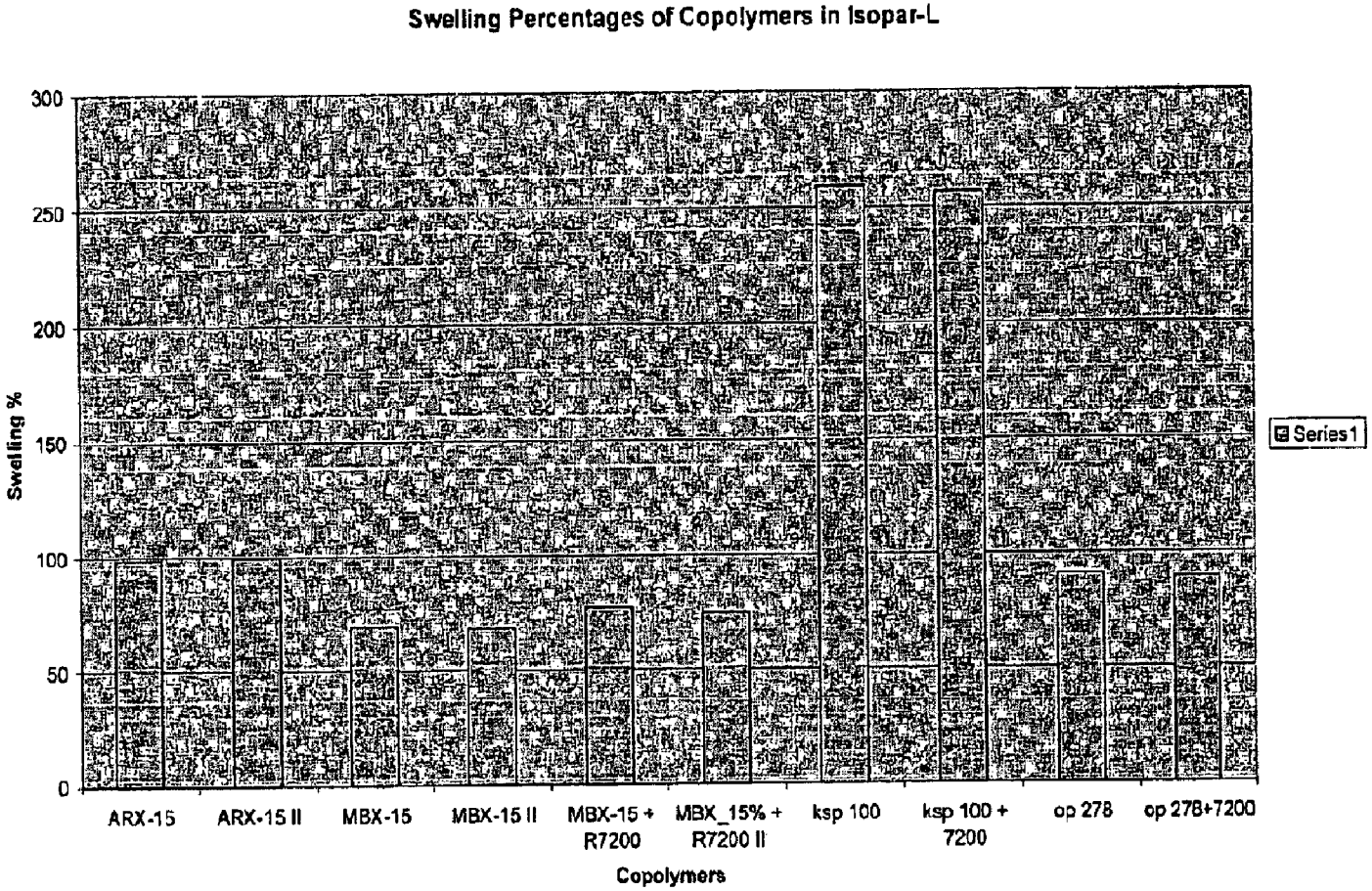
FIG. 2 depicts a graph showing experimental results regarding swelling of various cross-linked copolymer matrices in Isopar-L®.

Table II lists the measurements made during the experiment of the percentage of swelling of each of the toner particles containing each particular additive in Isopar-L® at 60° C. A graphic representation of the swelling percentages is included as FIG. 2.

TABLE II

Swelling

| Additive | Swelling [%] |
|---|---|
| ARX-15 | 99 |
| MBX-15 | 70 |
| MBX-15 + R7200 | 76 |
| KSP100 | 259 |
| KSP100 + R7200 | 257 |

TABLE II-continued

| Swelling | |
|---|---|
| Additive | Swelling [%] |
| OP278 | 91 |
| OP278 + R7200 | 89 |

The result of this experiment allows for some generalizations to be made regarding the various cross-linked copolymer additives and the reduction of background in LEP printing. First, it can be seen that the addition of silica does not necessarily increase the swelling of the KSP100 and OP278 matrices. It does appear, however, that it increases the swelling of the MBX-15 matrix, which is a related substance to ARX-15. The ARX-15 used for the experiment already had a silica additive, so results on the swelling of ARX-15 without silica are unavailable at this time. It is presumed that the ARX-15 swelling property is enhanced by the silica as is the MBX-15, due to their similarity.

Based on the data acquired regarding swelling in conjunction with the background reduction data, it appears that there may be a certain swollen matrix size which is optimal for trapping the free particles. For example, MBX-15 did not appear to trap free particles, and neither did KSP100 or OP278, but ARX-15 was effective. In an exemplary embodiment of the invention, the additive is chosen based on its anticipated swollen matrix size; a size effective for trapping the free particles;

Further experimentation regarding the ideal matrix size for reduction of background would likely reveal the optimum formulation of liquid toner including a cross-linked copolymer and/or silica, however, it has been determined through experimentation that the addition of ARX-15 and silica to traditional liquid toner provides the background reducing effect sought. Other cross-linked copolymers are believed to be suitable for this application; however, they were not included in the current round of experimentation. It is likely that other cross-linked copolymers which exhibit the same swollen matrix profile as the ARX-15 (for example having swelling of more than 80% or 90%) would be operationally effective, especially if used in conjunction with silica and on the condition that the swollen matrix has a chemical affinity to the resin.

In addition to the ability of the swollen cross-linked copolymer matrices to trap the free particles, it is believed that silica interacts with these particles to remove them from a free-floating state in the toner. Referring to the data in Table I, it can be seen that silica alone as an additive acts to reduce background in LEP printing. Therefore, it is also believed that silica as an additive to conventional liquid toner will be effective in improving background levels in LEP printing.

Moreover, experimental results show that silica enhances the swelling properties of certain cross-linked copolymers including MBX-15, a close relative of ARX-15. In other words, the addition of silica to a toner preparation including a cross-linked copolymer such as ARX-15 likely provides a synergistic effect helpful for reducing background printing. It is presumed that this synergy is directly related to the observation that free particles are absorbed into the swollen matrix of cross-linked copolymers and silica's ability to enhance the swelling of certain cross-linked copolymers.

For comparison, the Nucrel 699 was observed swelling approximately 75% and the A-C 5120 98%;

It has also been noted that liquid toners prepared with silica and/or cross-linked copolymers exhibit improved peeling, scratching, flaking and abrasion resistance in comparison to conventional liquid toners.

Usage of Toner Material

In practice, print quality is improved by using a toner formulation including a cross-linked copolymer, such as ARX-15, and/or silica as additives. It is believed that improvement is enhanced by a possible synergistic effect between the silica (which assists some cross-linked copolymers with swelling and/or captures the pigment) and the cross-linked copolymer. It has been further demonstrated that even just silica alone can reduce background in LEP printing.

In an exemplary embodiment of the invention, liquid toner including at least a cross-linked copolymer additive is loaded into a LEP machine. Additionally or alternatively, the liquid toner includes silica. Printing is performed as with conventional liquid toner to produce cleaner images with reduced background.

The present invention has been described using detailed descriptions of embodiments thereof that are provided by way of example and are not intended to limit the scope of the invention. For example, specific examples of binder resins and carrier liquids are given, but others known in the art can be used. In addition, the invention is capable of use with a variety of pigments, including those described specifically in this application and those known in the art. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. It should be understood that particular additives are used which are compatible with either the binder resin or the pigment, or both. Other additives besides those described herein are optionally selected depending on the binder resin and pigment used, in order to carry out the invention. When used in the following claims, the terms "comprises", "includes", "have" and their conjugates mean "including but not limited to". It should also be noted that the device is suitable for both males and female, with male pronouns being used for convenience. The scope of the invention is limited only by the following claims.

What is claimed is:

1. A toner for use in liquid electrostatic printing, comprising:

a carrier liquid; and, a plurality of toner particles, the toner particles being comprised of a pigment; and a mixture of resins, a major portion of said mixture comprising at least a first resin and a minor portion comprising at least one second resin, the second resin having an affinity for said pigment, that is greater than the affinity of the first resin for the pigment, such that the amount of free pigment in the carrier liquid separate from the toner particles is reduced over the amount that would be present in the absence of the at least one second resin of the minor portion.

2. The toner of claim 1, in which the second resin comprises a cross-linked copolymer.

3. The toner of claim 1, in which the second resin comprises 1-15% by total weight of the pigment.

4. The toner of claim 1, in which the second resin is swollen by absorbing carrier liquid.

5. The toner of claim 4, in which the second resin has a swelling ratio greater than 80%.

6. The toner of claim 1, further comprising silica.

7. The toner of claim 6, in which the silica comprises 0.1% to 4% of total weight of second resin.

8. The toner of claim 1, in which the second resin has affinity for the first resin.

9. The toner of claim 1, in which the second resin comprises at least one of:

acrylic acid moieties, polyacrylic ester, polybutyl methacrylate, and polymethyl methacrylate.

10. The toner of claim 1, in which the second resin comprises a copolymer polar moiety.

11. The toner of claim 10, in which second resin comprises cross-linked alkyl acrylate and ethyleneglycol dimethacrylate.

12. The toner of claim 1, in which the carrier liquid is a hydrocarbon.

13. The toner of claim 1, in which the pigment is pretreated for enhanced affinity to the second resin.

14. A toner for use in liquid electrostatic printing, comprising:

a carrier liquid; and, a plurality of toner particles, the toner particles being comprised of a pigment; and a mixture of at least two resins, a major portion of said mixture comprising at least one first resin with a first swelling ratio and a minor portion comprising at least one second resin having second swelling ratio, wherein said second resin has an affinity for said pigment, at least when swelled according to the second swelling ratio in the carrier liquid, that is greater than the affinity of the first resin for the pigment, such that the amount of free pigment in the carrier liquid separate from the toner particles is reduced over the amount that would be present in the absence of the at least one second resin of the minor portion.

15. The toner of claim 14, further comprising silica, the silica comprising 0.1% to 4% of total weight of second resin, the silica increasing the swelling ratio of the second resin.

16. A toner for use in liquid electrostatic printing, comprising:

a carrier liquid; and, a plurality of toner particles, the toner particles being comprised of a pigment; and a mixture of at least two resins, a major portion of said mixture comprising at least one first resin and a minor portion comprising at least one second resin having a matrix structure suitable for capturing the pigment, such that the amount of free pigment in the carrier liquid separate from the toner particles is reduced over the amount that would be present in the absence of the at least one second resin of the minor portion.

17. The toner of claim 16, further comprising silica, the silica comprising 0.1% to 4% of total weight of second resin, the silica increasing the swelling ratio of the second resin.

18. A method of preparing liquid toner, comprising:

mixing at least a carrier liquid, a resin and a polymer to produce a slurry of the carrier liquid and plasticized polymer particles;

adding a cross-linked copolymer and a pigment to said slurry; and, grinding the slurry, the cross-linked copolymer and pigment to form pigmented toner particles, wherein the cross-linked copolymer reduces the amount of one or both of free resin and pigment particles than would have been present if the cross-linked copolymer had not been added.

19. A toner for use in liquid electrostatic printing, comprising:

a hydrocarbon carrier fluid;

a pigment;

a ethylene methacrylic acide copolymer resin in an amount of 10-35% by total weight;

an ethylene acrylic copolymer in an amount of 5%-30% by total weight;

a crosslinked poly acrylic ester 1 to 15% by total weight, having an affinity for the pigment and the resin and swelling by at least 80% in the hydrocarbon carrier fluid; and silica in an amount of 0.1% to 4% by total weight of crosslinked copolymer additive;

in which an amount of free pigment in the carrier liquid separate from the toner particles is reduced over the amount that would be present in the absence of the at least one second resin of the crosslinked poly acrylic ester and the silica.

* * * * *

UNITED STATES PATENT AND TRADEMARK OFFICE

CERTIFICATE OF CORRECTION

PATENT NO. : 8,288,068 B2
APPLICATION NO. : 12/281520
DATED : October 16, 2012
INVENTOR(S) : Victor Gal et al.

It is certified that error appears in the above-identified patent and that said Letters Patent is hereby corrected as shown below:

In column 14, line 29, in Claim 19, delete “acide” and insert -- acid --, therefor.

Signed and Sealed this
Nineteenth Day of March, 2013

Teresa Stanek Rea
*Acting Director of the United States Patent and Trademark Office*